US008628076B2

(12) United States Patent
Ikeda

(10) Patent No.: US 8,628,076 B2
(45) Date of Patent: Jan. 14, 2014

(54) SHEET FEEDING DEVICE AND IMAGE FORMING APPARATUS

(71) Applicant: Canon Kabushiki Kaisha, Tokyo (JP)

(72) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/678,943

(22) Filed: Nov. 16, 2012

(65) Prior Publication Data

US 2013/0127109 A1 May 23, 2013

(30) Foreign Application Priority Data

Nov. 21, 2011 (JP) ..... 2011-253960

(51) Int. Cl.
*B65H 3/14* (2006.01)

(52) U.S. Cl.
USPC ..... 271/98; 271/4.02; 271/265.01; 271/276

(58) Field of Classification Search
USPC ..... 271/98, 31, 4.02, 265.01, 276, 198
See application file for complete search history.

(56) References Cited

U.S. PATENT DOCUMENTS

| | | | | |
|---|---|---|---|---|
| 5,921,540 | A * | 7/1999 | Acquaviva et al. | 271/98 |
| 7,635,125 | B2 * | 12/2009 | Ikeda | 271/31 |
| 7,744,081 | B2 * | 6/2010 | Ikeda | 271/98 |
| 7,850,162 | B2 * | 12/2010 | Imai et al. | 271/31 |
| 8,079,585 | B2 * | 12/2011 | Fujita | 271/98 |
| 8,210,518 | B2 * | 7/2012 | Suzuki | 271/97 |
| 8,444,138 | B2 * | 5/2013 | Taki | 271/108 |

FOREIGN PATENT DOCUMENTS

JP 2007-276910 A 10/2007

* cited by examiner

*Primary Examiner* — David H Bollinger
(74) *Attorney, Agent, or Firm* — Canon USA Inc IP Division

(57) ABSTRACT

A sheet feeding device, capable of reliably feeding sheets that have a curl, includes a sheet surface detection mechanism configured to detect an upper surface of a topmost sheet of sheets supported on a tray. The sheet surface detection mechanism includes a sensor unit arranged on a upstream side of a suction and conveyance mechanism in a sheet conveyance direction, a sensor lever configured to turn the sensor unit ON/OFF, and a detection unit having one end connected to the sensor lever and another end that extends toward a downstream side in the sheet conveyance direction. The detection unit includes, on a downstream side in the sheet conveyance direction, a protruding member that protrudes in a downward direction and that is capable of contacting the topmost sheet supported on the tray.

9 Claims, 11 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly to a sheet feeding device that separates and feeds sheets by blowing air on the sheets.

2. Description of the Related Art

Conventionally, as an image forming apparatus such as a copying machine or a printer, an image forming apparatus has been proposed that includes an air-blowing sheet feeding device that floats sheets by blowing air onto them so that the sheets are conveyed by suction to a suction conveyance belt.

Japanese Patent Application Laid-Open No. 2007-276910 discusses a sheet feeding device capable of reliably feeding sheets whose edge portion on the downstream side in the sheet conveyance direction has a curl that bends upward (hereinafter referred to as "upward curl").

The sheet feeding device discussed in Japanese Patent Application Laid-Open No. 2007-276910 will now be described based on FIG. 11A. Sheet surface control is performed based on position detection of a topmost sheet by a sheet surface detection mechanism 49 so that a distance between a suction conveyance belt 21 and the topmost sheet is within an appropriate range S1. At the edge portion of the sheet on the downstream side in the sheet conveyance direction, which is near an air blowing unit 30, sheet surface control is performed so that the distance of the topmost sheet from the suction conveyance belt 21 is within the range S1. Consequently, the blowing of air by the air blowing unit 30, and the suction and conveyance by the suction conveyance belt 21 are appropriately performed.

This sheet feeding device has a detection unit 61, which is connected to a sensor lever 52 that turns a sensor unit (including a first sheet surface sensor 54 and a second sheet surface sensor 55) ON/OFF. The detection unit 61 extends toward the downstream side in the sheet conveyance direction. Sheet surface control is performed by the detection unit 61 contacting the topmost surface of the sheets stacked on an elevating tray, to position the topmost stacked sheet within an appropriate range by turning the sensor unit ON/OFF to raise or lower the elevating tray.

As illustrated in FIG. 11A, at the edge portion of the sheet on the downstream side in the sheet conveyance direction, for an upward curl sheet, sheet surface control is performed by the detection unit 61 contacting the topmost sheet so that the distance of the topmost stacked sheet from the suction conveyance belt 21 is within the appropriate range S1. Consequently, the blowing of air by the air blowing unit 30 and the suction and conveyance by the suction conveyance belt 21 can be appropriately performed, thus enabling the sheets to be reliably separated and fed.

However, in the sheet feeding device discussed in Japanese Patent Application Laid-Open No. 2007-276910, there is still room for improvement when the edge portion on the downstream side in the sheet conveyance direction has a curl that bends downward (hereinafter referred to as "downward curl").

As illustrated in FIG. 11B, in the sheet feeding device discussed in Japanese Patent Application Laid-Open No. 2007-276910, sheet surface control is performed so that, even for a sheet that has a downward curl, the topmost sheet is positioned within the range S1. However, in this case, the position where the detection unit 61 contacts the topmost sheet is a position away from the air blowing unit 30 on the upstream side in the feeding direction. Consequently, the distance between the topmost sheet and the suction conveyance belt 21 at the edge portion of the sheet on the downstream side in the sheet conveyance direction that is near the air blowing unit 30 becomes S2, so that the topmost sheet is substantially out of the appropriate range S1.

Consequently, when trying to convey the sheets by suction, the suction can be incomplete, so that the leading edge of the fed sheets may hit a downstream guide, thereby causing problems such as paper jamming. Further, it can become impossible to convey the sheet by suction because the gap between the sheet and the suction conveyance belt is too wide.

SUMMARY OF THE INVENTION

An example of the present invention is directed to a sheet feeding device capable of reliably feeding even sheets that have upward curl or downward curl.

According to an aspect of the present invention, a sheet feeding device includes an elevating tray configured to be movable up and down and to support sheets, an air blowing unit configured to blow air onto sheets supported on the elevating tray to float the sheets, a suction and conveyance mechanism configured to suction and convey a topmost sheet of the sheets floated by air blown by the air blowing unit, and a sheet surface detection mechanism configured to detect an upper surface of the topmost sheet of the sheets supported on the elevating tray, wherein the sheet surface detection mechanism includes a sensor unit arranged on a upstream side of the suction and conveyance mechanism in a sheet conveyance direction, a sensor lever configured to turn the sensor unit ON/OFF, and a detection unit having one end connected to the sensor lever and another end that extends toward a downstream side in the sheet conveyance direction, and wherein the detection unit includes, on a downstream side in the sheet conveyance direction, a protruding member that protrudes in a downward direction and that is capable of contacting the topmost sheet supported on the elevating tray.

According to an exemplary embodiment of the present invention, since a detection unit in a sheet surface detection mechanism includes a protruding member that protrudes downward on a downstream side in a sheet conveyance direction, appropriate sheet surface control can be performed, and sheets having downward curl can be reliably fed. Further, even sheets having upward curl or no curl can be reliably fed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
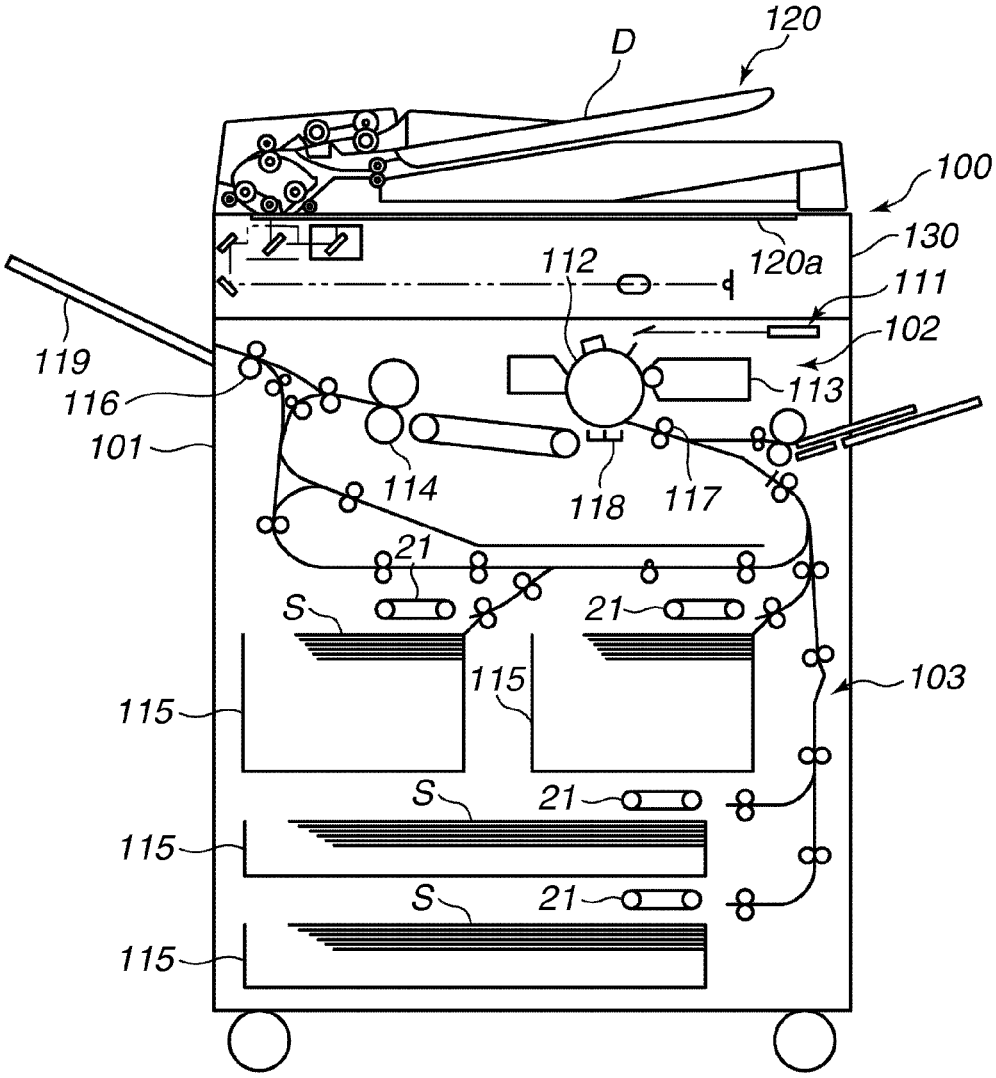
FIG. 1 illustrates an entire configuration of a printer, which is an example of an image forming apparatus that includes a sheet feeding device according to an exemplary embodiment of the present invention.

FIG. 1 illustrates an entire configuration of a printer, which is an example of an image forming apparatus that includes a sheet feeding device according to an exemplary embodiment of the present invention.

The printer 100 illustrated in FIG. 1 includes a printer body 101. On an upper portion of the printer body 101 is provided an image reading unit 130 that reads, on a platen glass 102*a*, an original document D fed from an automatic document feeding device 120. Further, on a lower portion of the image reading unit 130 is provided an image forming unit 102 and a sheet feeding device 103 that feeds a sheet S to the image forming unit 102.

The image forming unit 102 includes a photosensitive drum 112, a development unit 113, a laser scanner unit 111, a transfer charging device 118, and a fixing unit 114. The sheet feeding device 103 includes a plurality of sheet storage units 115, which store sheets S such as an overhead transparency (OHT) and can be attached/detached to/from the printer body 101. The sheet feeding device 103 also includes a suction conveyance belt 21 that feeds the sheets S stored in the sheet storage units 115.

Next, an image forming operation performed by the printer 100 having such a configuration will be described.

When an image read signal is output to the image reading unit 130 from a (not illustrated) control apparatus provided in the printer body 101, an image is read by the image reading unit 130. Then, laser light corresponding to this electric signal is irradiated onto the photosensitive drum 112 from the laser scanner unit 111.

At this stage, the photosensitive drum 112 has already been charged, so an electrostatic latent image is formed by the irradiation of the light. The electrostatic latent image is developed by the development unit 113, so that a toner image is formed on the photosensitive drum.

When a sheet feeding signal is output to the sheet feeding device 103 from the control apparatus, a sheet S is fed from a sheet storage unit 115. The fed sheet S is synchronized with the toner image on the photosensitive drum by a registration roller 117, and fed to a transfer unit configured from the photosensitive drum 112 and the transfer charging device 118.

Next, the toner image is transferred onto the sheet S fed to the transfer unit, and then the sheet S is conveyed to the fixing unit 114. The fixing unit 114 applies heat and pressure on the sheet S to fix the non-fixed transfer image on the sheet S. The sheet S on which the image is fixed is then discharged from the printer body 101 to a discharge tray 119 by a discharge roller 116.

Next, the configuration of the sheet feeding device 103 according to an exemplary embodiment of the present invention will be described with reference to the schematic diagram illustrated in FIG. 2.

Figure 2:
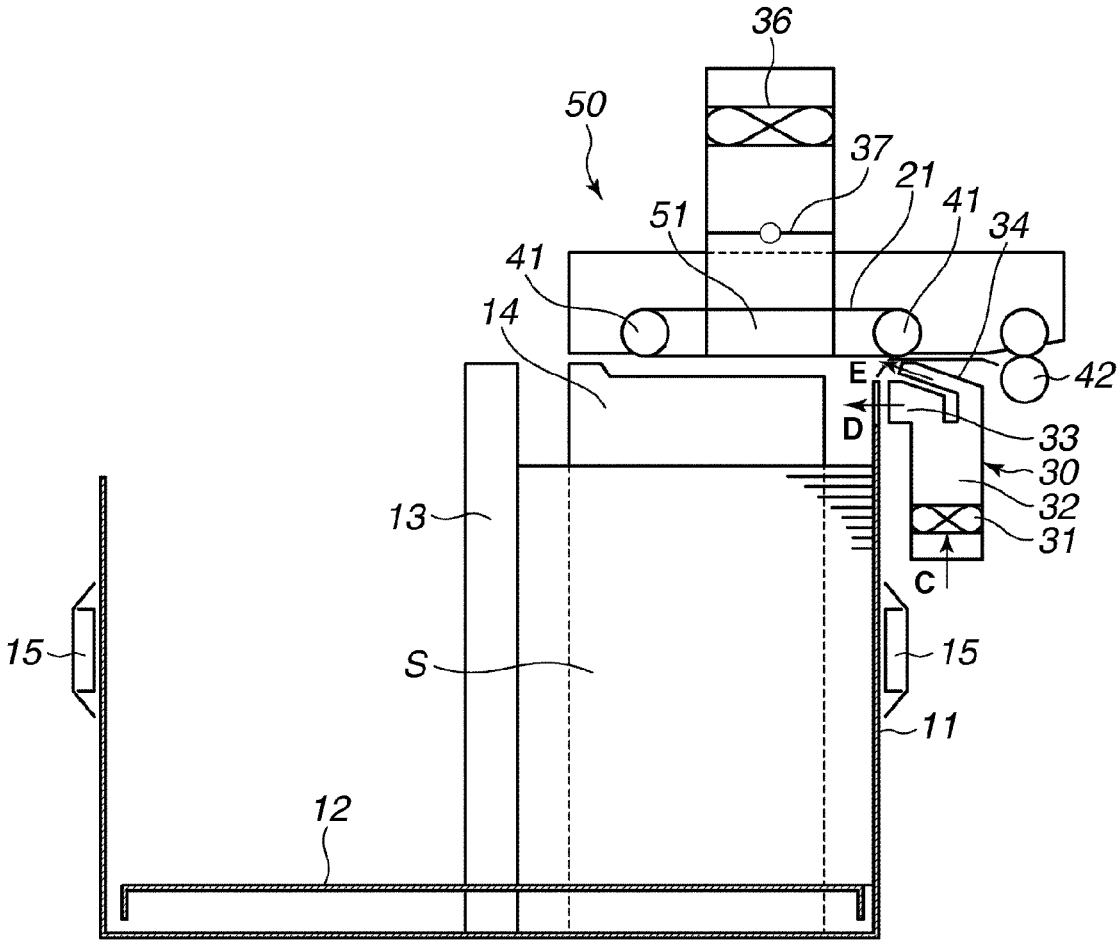
FIG. 2 illustrates a configuration of a sheet feeding device.

The configuration illustrated in FIG. 2 includes a repository 11 for storing sheets and an elevating tray 12 that supports the sheets and can be raised or lowered by a (not illustrated) drive unit. The repository 11 includes a trailing edge regulating plate 13 that regulates the downstream side (trailing edge) in the feeding direction of the sheet S, and a side edge regulating plate 14 that regulates the position of the sheet S in a width direction that is orthogonal to the sheet feeding direction of the sheet S. The trailing edge regulating plate 13 and the side edge regulating plate 14 are configured so that their position can be freely changed based on the size of the stored sheets. Further, this repository 11 can be pulled out from the printer body 101 via a slide rail 15.

The sheet feeding device 103 includes an air blowing unit 30 that causes the sheets to float by blowing air onto the sheets S supported on the elevating tray 12, and a suction and conveyance mechanism 50 that conveys the topmost floated sheet by suction.

The air blowing unit 30 includes a blowing nozzle 33 and a separation nozzle 34 for blowing air onto an upper edge portion of the stored sheets S, a separation fan 31, and a separation duct 32 for sending air from the separation fan 31 to the respective nozzles 33 and 24.

The suction and conveyance mechanism 50 includes the suction conveyance belt 21, which is hung around a belt drive roller 41 and conveys the sheets S in the right direction in FIG. 2 by suction. Further, the suction and conveyance mechanism 50 includes a suction fan 36 that generates negative pressure for suctioning the sheets S onto the suction conveyance belt 21, and a suction duct 51 arranged on an inner side of the suction conveyance belt 21 for suctioning air via suction holes that are formed in the suction conveyance belt 21. A suction shutter 37 that turns the suction operation of the suction conveyance belt 21 ON/OFF is arranged between the suction fan 36 and the suction duct 51.

In the present exemplary embodiment, the suction conveyance belt 21 includes a plurality of (three) belt pieces arranged at predetermined intervals in the width direction orthogonal to the sheet conveyance direction. Suction holes are formed in each of the belt pieces of the suction conveyance belt 21.

Next, a sheet feeding operation of the thus-configured sheet feeding device 103 will be described.

First, the user pulls out the repository 11 and sets a stack of sheets S on the elevating tray 12. Then, when the stack is stored at a predetermined position in the image forming apparatus, the elevating tray 12 starts to be lifted by a drive unit. When the distance between the topmost sheet of the sheets S supported on the elevating tray 12 and the suction conveyance belt 21 reaches a predetermined position, the (not illustrated) control apparatus temporarily stops the elevating tray 12 at that position. Then, the image forming apparatus gets ready for the sheet feeding signal for starting sheet feeding.

Next, when the (not illustrated) control apparatus detects a sheet feeding signal, the control apparatus activates the separation fan 31, which suctions air in the direction of the arrow C. This air is blown onto the sheets from the directions of the arrows D and E from the blowing nozzle 33 and the separation nozzle 34, respectively. Consequently, a plurality of the top sheets among the sheets supported on the elevating tray 12 are floated. Further, the control apparatus activates the suction fan 36, and discharges air in the direction of arrow F in FIG. 3. During this operation, the suction shutter 37 is still closed.

Figure 3:
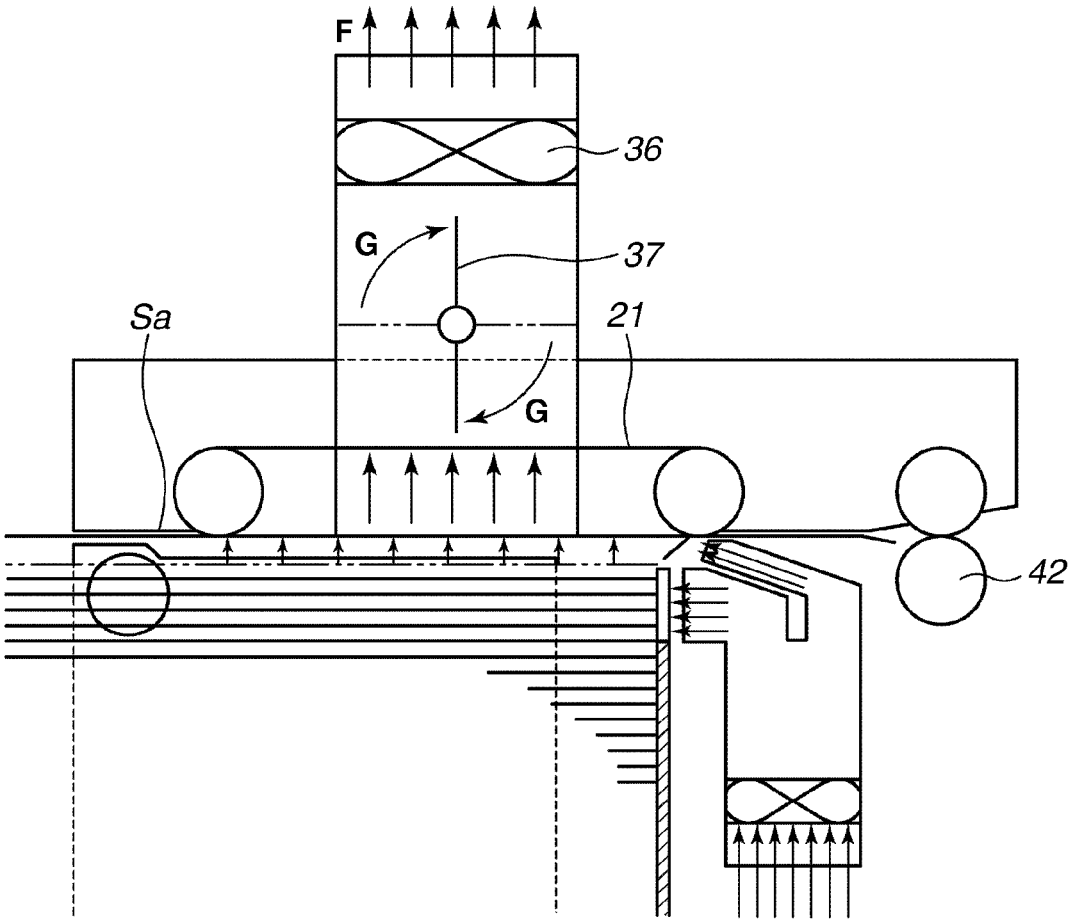
FIG. 3 illustrates a sheet feeding operation in a sheet feeding device.

Next, as illustrated in FIG. 3, when the floating of the plurality of top sheets has stabilized, the control apparatus rotates the suction shutter 37 in the direction of the arrow G to generate a suction force from the suction holes provided in the suction conveyance belt 21. Due to this suction force and the separation air from the separation nozzle 34, just the topmost sheet Sa is suctioned onto the suction conveyance belt 21.

Figure 4:
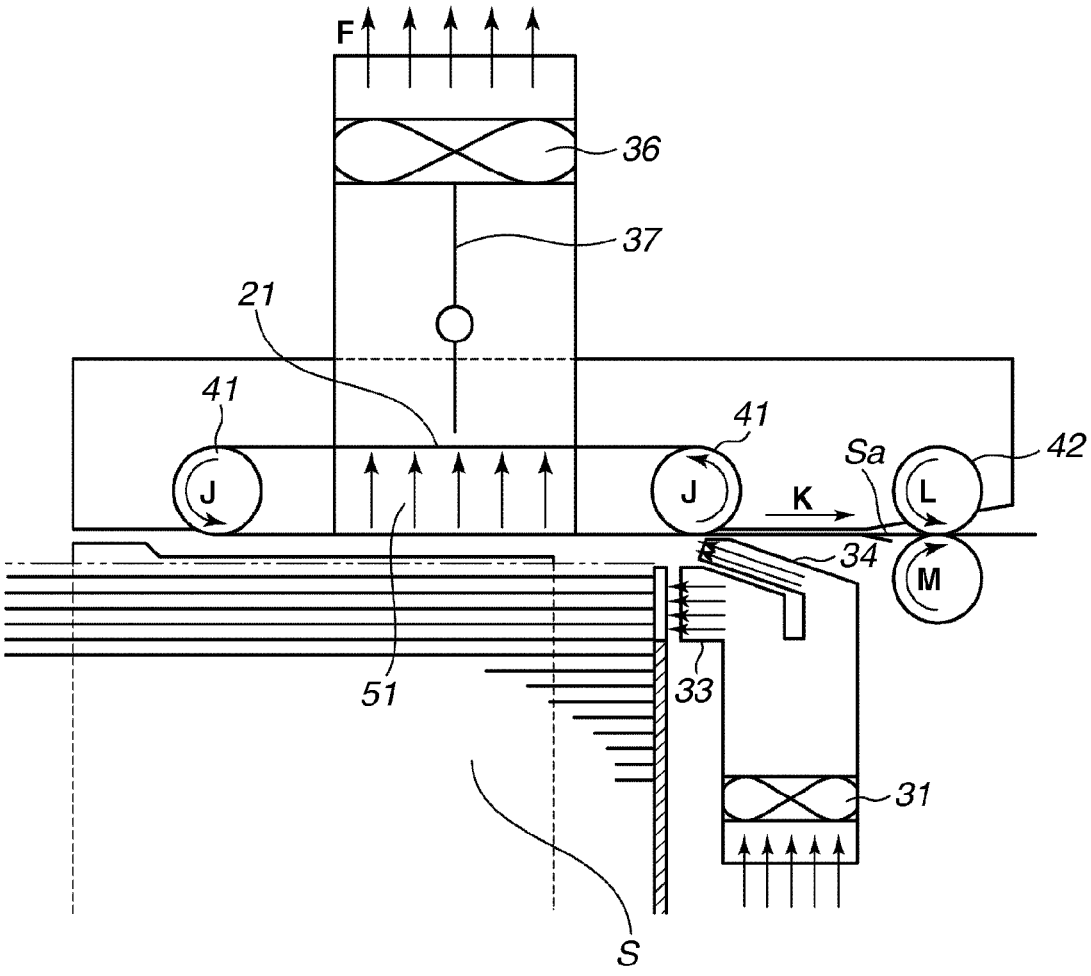
FIG. 4 illustrates a sheet feeding operation in a sheet feeding device.

Next, by rotating a belt drive roller 41, as illustrated in FIG. 4, in the direction of the arrow J, the topmost sheet Sa is conveyed in the direction of the arrow K while still suctioned to the suction conveyance belt 21. Then, the sheet Sa is fed to the image forming unit by a pair of drawing rollers 42 rotating in the direction of arrows L and M.

Figure 5A:
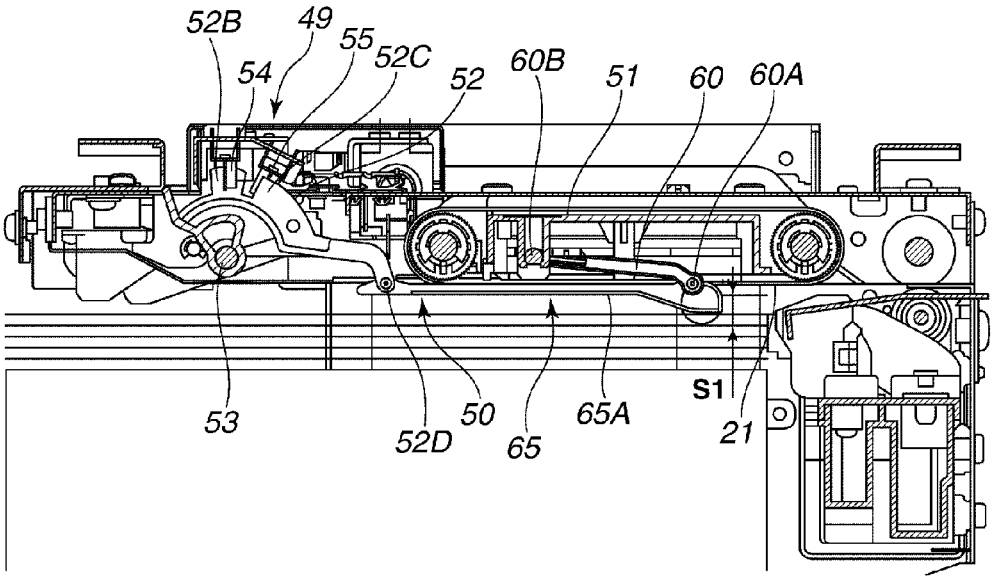
FIGS. 5A and 5B illustrate a detection unit in a sheet feeding device according to a first exemplary embodiment of the present invention.
Figure 5B:
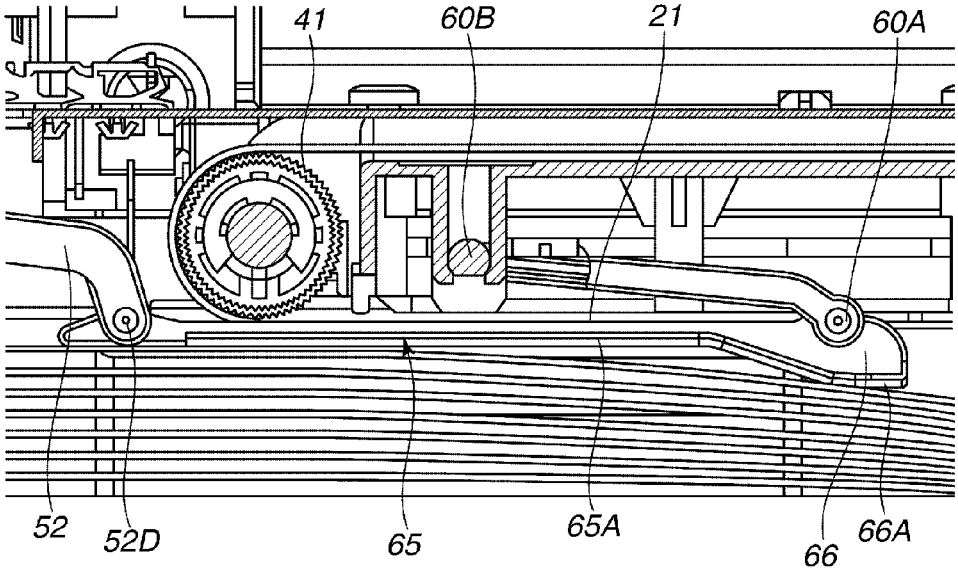

Next, the sheet surface detection mechanism according to a first exemplary embodiment of the present invention will be described. FIG. 5A illustrates a sheet feeding device according to the first exemplary embodiment. FIG. 5B is an enlarged view of the main portions of the sheet surface detection mechanism, which illustrates a below-described detection state of a sheet having downward curl. The reference numerals in FIG. 5A denote the same members as the members shown by the reference numerals in FIG. 2. As illustrated in FIG. 5A, a sheet surface detection mechanism 49 includes a sensor unit (a first sheet surface sensor 54 and a second sheet surface sensor 55) arranged on an upstream side in the sheet conveyance direction, a sensor lever 52, and a detection unit 65.

The sensor lever 52 includes a first detection unit 52B that shields a received light portion of the first sheet surface sensor 54 and performs position detection, and a second detection unit 52C that shields a received light portion of the second sheet surface sensor 55 and performs position detection. Further, the sensor lever 52 is supported on a support shaft 53 so that the sensor lever 52 can freely swing.

The configuration of the detection unit 65 will now be described in more detail with reference to FIG. 5B. One end of the detection unit 65 is rotatably connected to the sensor lever 52 by a joint 52D. The other end of the detection unit 65 includes a base member 65A that extends toward the downstream side in the sheet conveyance direction. The leading edge of the base member 65A is rotatably connected to a connecting member 60 by a joint 60A. The connecting member 60 is rotatably attached inside the suction duct 51 by a support shaft 60B so that the connecting member 60 can be housed in the suction duct 51 from a space between a plurality of belt pieces of the suction conveyance belt 21. A link mechanism is configured from the sensor lever 52, the detection unit 65, and the connecting member 60 using the joints 52D and 60A as joints. The base member 65A of the detection unit 65 is configured so that the base member 65A can be housed in the suction duct 51 from a space between the plurality of belt pieces of the suction conveyance belt 21 when the topmost sheet is suctioned to the suction conveyance belt 21.

On the downstream side in the sheet conveyance direction of the base member 65A of the detection unit 65, a protruding member 66 is formed that protrudes in a downward direction and that can contact the topmost sheet supported on the elevating tray. This protruding member 66 is fixed to an edge portion in the downstream side of the detection unit 65. The detection unit 65 can move up and down when the topmost sheet supported on the elevating tray 12 contact the protruding member 66 or the base member 65A. Further, in conjunction with the up/down movement of the detection unit 65, the sensor lever 52 swings about the support shaft 53 to turn the first sheet surface sensor 54 and the second sheet surface sensor 55 ON/OFF.

As illustrated in FIG. 5B, if the distance from the belt surface of the suction conveyance belt 21 to a leading edge 66A of the protruding member 66 is within the predetermined range S1, air blowing by the air blowing unit 30, and the suction and conveyance by the suction and conveyance mechanism 50 can be appropriately performed. Consequently, this enables the sheets to be reliably fed.

Next, a sheet surface control operation of the sheet surface detection mechanism 49 will be described.

The sheets stored in the repository 11 are lifted up by raising the elevating tray 12 so that the upper surface of the topmost sheet Sa contacts the protruding member 66 of the detection unit 65. Then, when the elevating tray 12 is subsequently raised further, the detection unit 65 rises. In conjunction with the rise of the detection unit 65, the sheet surface sensor lever 52 swings about the support shaft 53 in a direction in which the joint 52D moves upward.

Figure 6:
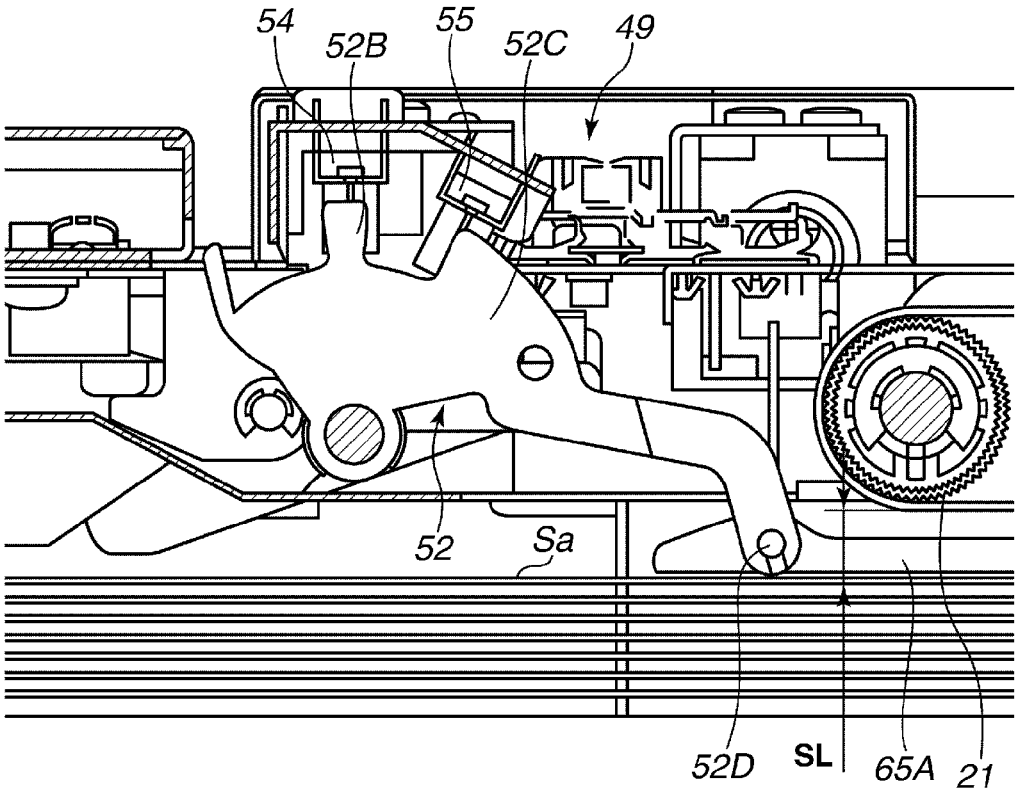
FIG. 6 illustrates a sheet surface control operation in a sheet feeding device according to the first exemplary embodiment.

As illustrated in FIG. 6, when the distance between the upper surface of the raised topmost sheet Sa and the belt surface of the suction conveyance belt 21 is SL while raising the detection unit 65, the sheet surface sensors 54 and 55 are shielded by the detection units 52B and 52C, respectively, of the sensor lever 52. Consequently, the first sheet surface sensor 54 and the second sheet surface sensor 55 output an ON signal. When the first sheet surface sensor 54 and the second sheet surface sensor 55 output the ON signal, based on this ON signal, the control apparatus stops raising the elevating tray 12. This position is set as the lower limit for the sheet floating region. Subsequently, the control apparatus floats the sheets by starting air blowing with the air blowing unit 30.

Figure 7A:
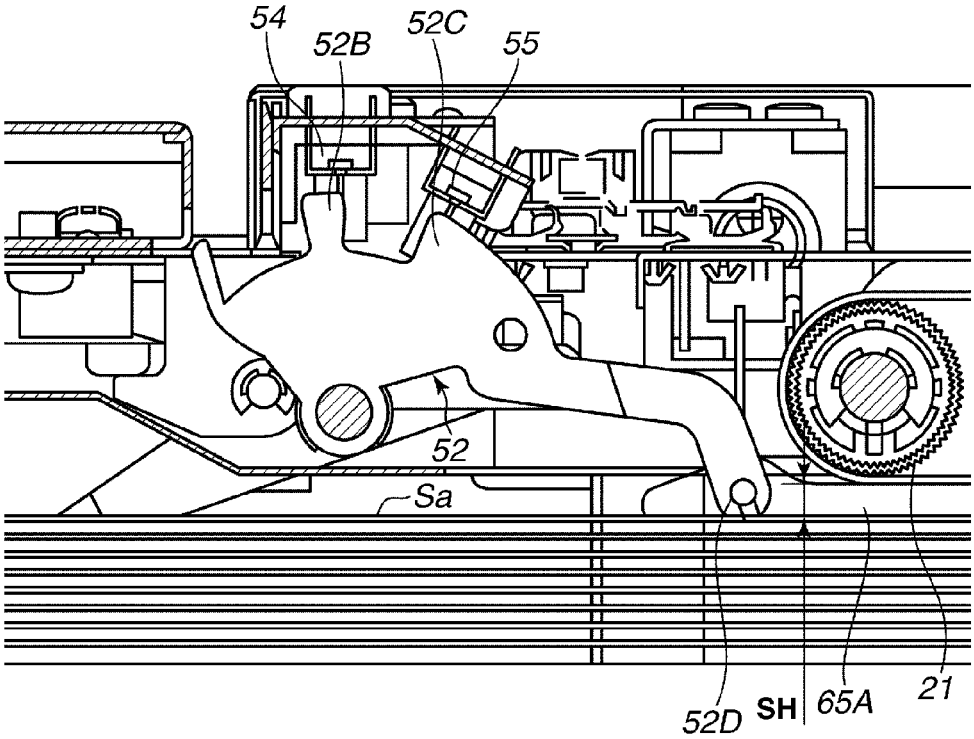
FIGS. 7A and 7B illustrate a sheet surface control operation in a sheet feeding device according to the first exemplary embodiment.

Next, after the sheets are floated in this manner, as illustrated in FIG. 7A, the distance between the belt surface of the suction conveyance belt 21 and the upper surface of the topmost sheet Sa is SH, and the first sheet surface sensor 54 is no longer shielded by the first detection unit 52B of the sheet surface sensor lever 52. Consequently, with the second sheet surface sensor 55 outputting an ON signal, the first sheet surface sensor 54 outputs an OFF signal. In this case, the upper surface of the topmost sheet Sa is determined to be "too high", so that the elevating tray 12 is lowered until an ON signal is obtained from the first sheet surface sensor 54. Then, when an ON signal is output from the first sheet surface sensor 54, the control apparatus stops lowering the elevating tray 12. This position is set as the upper limit for the sheet floating region. Thus, the sheets can be reliably conveyed by the suction conveyance belt 21 by positioning the leading edge side of the topmost sheet Sa of the sheets on the elevating tray 12 between the lower limit (SL) and the upper limit (SH) of the sheet floating region. The lower limit (SL) and the upper limit (SH) of this sheet floating region constitute the range S1 in the height direction within which the sheets can be reliably fed.

Figure 7B:
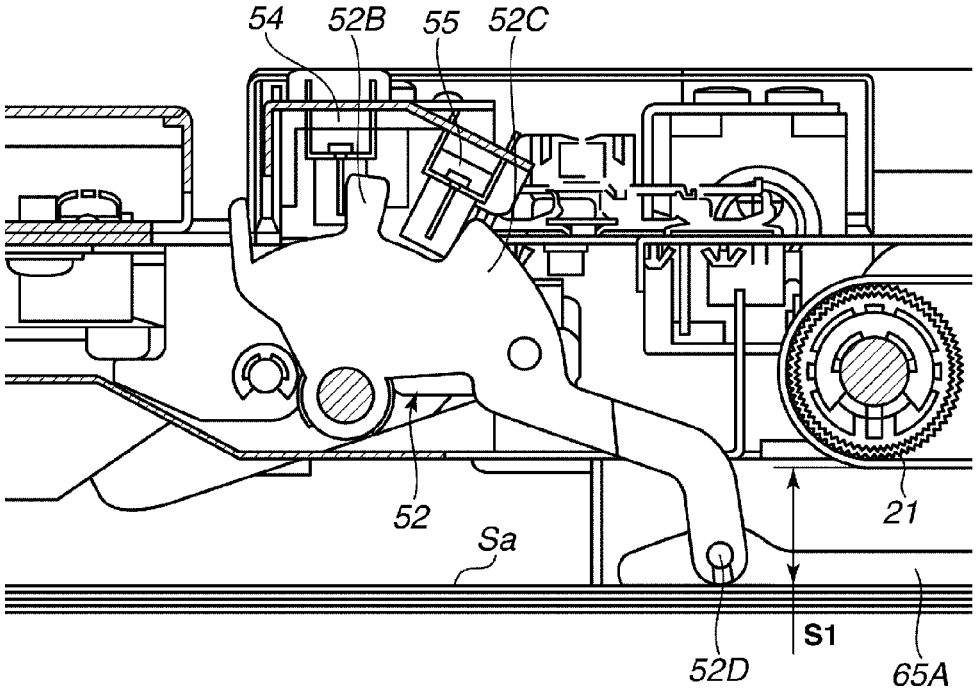

When the distance between the belt surface of the suction conveyance belt 21 and the upper surface of the topmost sheet Sa is lower than SL, as illustrated in FIG. 7B, the second sheet surface sensor 55 outputs an OFF signal. In this case, the position of the topmost sheet Sa is determined to be "too low", so that the elevating tray 12 is raised until an ON signal is obtained from the second sheet surface sensor 55 with the first sheet surface sensor 54 outputting an ON signal.

The elevating tray 12 is thus raised and lowered based on detection signals from the first sheet surface sensor 54 and the second sheet surface sensor 55 so that the position of the topmost sheet Sa of the sheets on the elevating tray 12 is maintained between the lower limit and the upper limit of the sheet floating region. Consequently, even when the sheet quantity gradually decreases due to feeding of the sheets, the position of the topmost sheet Sa can be maintained within the feedable range S1 by raising the elevating tray 12.

Table 1 shows the series of operations performed after the air blowing is started.

TABLE 1

| First Sheet Surface Sensor 54 | Second Sheet Surface Sensor 55 | Tray Operation |
|---|---|---|
| ON | OFF | Raise |
| ON | ON | Stop |
| OFF | ON | Lower |

Thus, in the present exemplary embodiment, the elevating tray 12 is raised and lowered based on signals from the first and second sheet surface sensors 54 and 55. This operation enables the control apparatus to perform control such that the position of the elevating tray 12 when air is being blown is maintained at a position that allows the suction conveyance belt 21 to suction and convey only the topmost sheet Sa. Consequently, when suctioning a sheet with the suction conveyance belt 21, the sheets S can be individually separated and fed toward the image forming unit, which enables stable sheet feeding.

Further, by using the detection unit 65 that extends as far as the upstream side of the suction and conveyance region, sheet surface detection can be performed even when the first and second sheet surface sensors 54 and 55 are provided at a position that is behind the suction and conveyance region of the suction conveyance belt 21 of the suction and conveyance mechanism 50.

In addition, at the downstream side in the sheet conveyance direction, the protruding member 66 protruding in a downward direction from the base member 65A of the detection unit 65 contacts the sheet, so that sheet surface detection is performed. Thus, even downward curl sheets can be reliably fed. Specifically, when the sheets supported on the elevating tray 12 curl downward, the protruding member 66 contacts the downward curling portion (the leading edge side of the sheet) of the topmost sheet Sa. The elevating tray 12 is raised and lowered based on signals from the first and second sheet surface sensors 54 and 55 so that the leading edge side of the topmost sheet Sa is positioned at a position where a distance from the belt surface of the suction conveyance belt 21 is within the range S1. Consequently, the leading edge side of the topmost sheet Sa is at a position where the sheet can be reliably suctioned onto the suction conveyance belt 21, so that the sheet can be reliably separated by the air blown from the separation nozzle 34. Therefore, jamming and feeding problems can be prevented even for sheets that curl downward.

Figure 8:
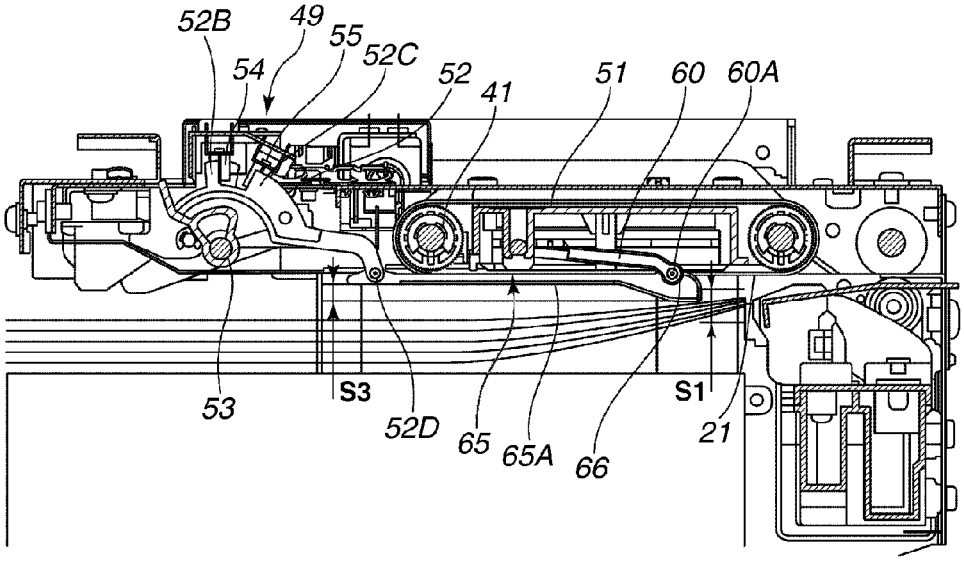
FIG. 8 is a cross-sectional view illustrating a state of a sheet feeding device, for sheets having upward curl, according to the first exemplary embodiment.

FIG. 8 illustrates a case in which a sheet curls upward. In this case too, since sheet surface control is performed by pressing the protruding member 66 protruding in a downward direction against the floated topmost sheet Sa at the downstream side in the sheet conveyance direction, the leading edge side of the sheet is positioned at a position where a distance from the belt surface of the suction conveyance belt 21 is kept within the range S1. Therefore, even sheets curling upward can be reliably fed. Further, sheets that are not curled can be reliably fed in a conventional manner.

Next, a second exemplary embodiment of the present invention will be described. Except for the configuration of the detection unit, the second exemplary embodiment is the same as the first exemplary embodiment.

Figure 9:
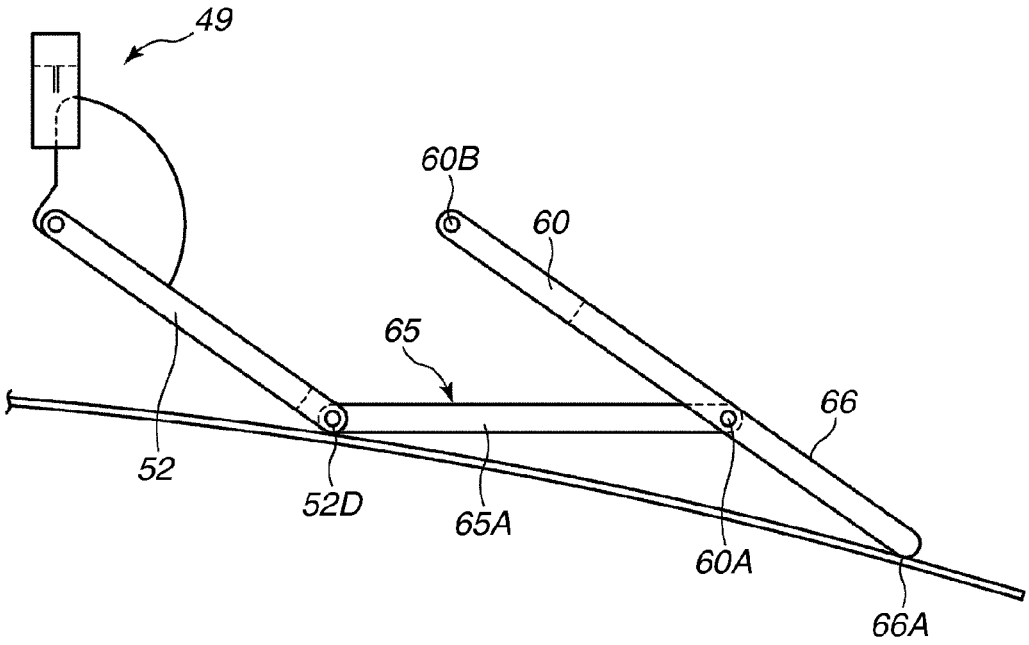
FIG. 9 illustrates a sheet feeding device according to a second exemplary embodiment.

As illustrated in FIG. 9, in the second exemplary embodiment according to the present invention, the protruding member 66 of the detection unit 65 is configured so that the connecting member 60 protrudes downward beyond the joint 60A. Therefore, the leading edge 66A of the protruding member 66 is positioned lower than the joints 52D and 60A.

The sheets curling downward contacts the leading edge 66A of the protruding member 66 or the base member 65A, lifts the detection unit 65, and raises or lowers the elevating tray 12 based on detection by the sensor unit. Thus, the topmost sheet is moved to an appropriate position. Further, the second exemplary embodiment also enjoys the same advantageous effects as the first exemplary embodiment.

A third exemplary embodiment of the present invention will now be described. Except for the configuration of the detection unit, the third exemplary embodiment is the same as the first exemplary embodiment.

Figure 10:
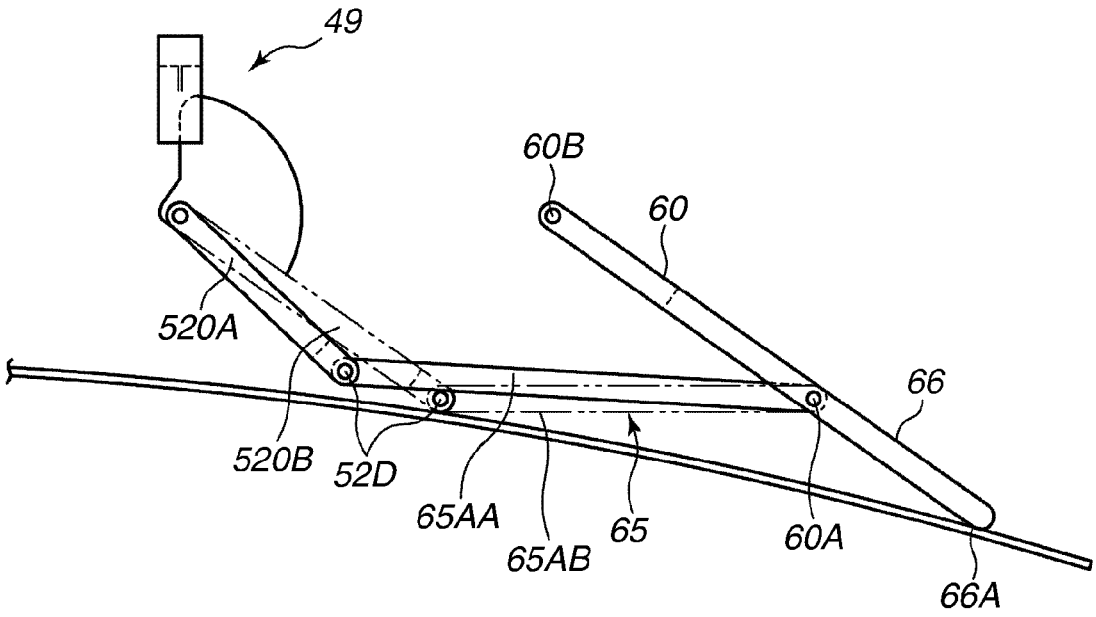
FIG. 10 illustrates a sheet feeding device according to a third exemplary embodiment.
Figure 11A:
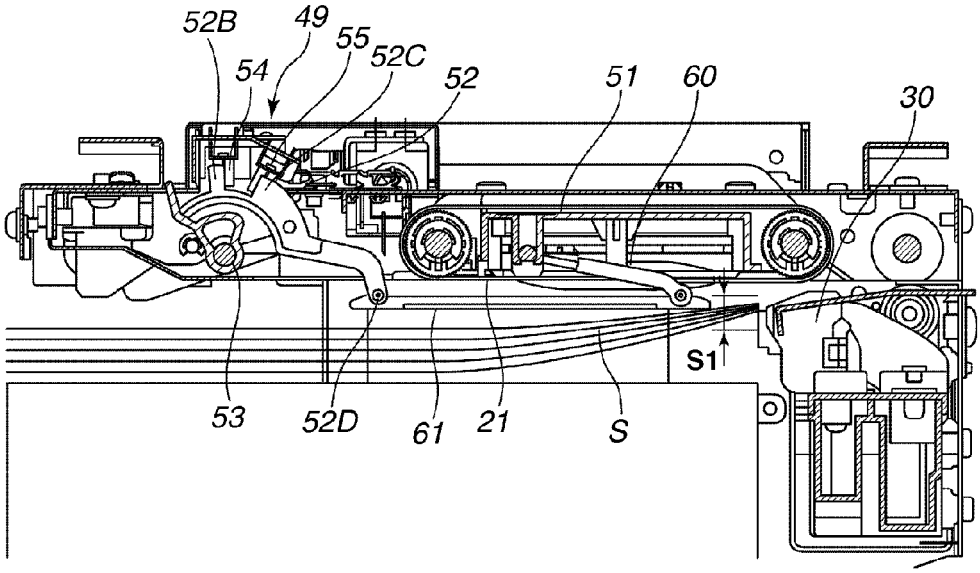
FIGS. 11A and 11B illustrates a conventional sheet feeding device.
Figure 11B:
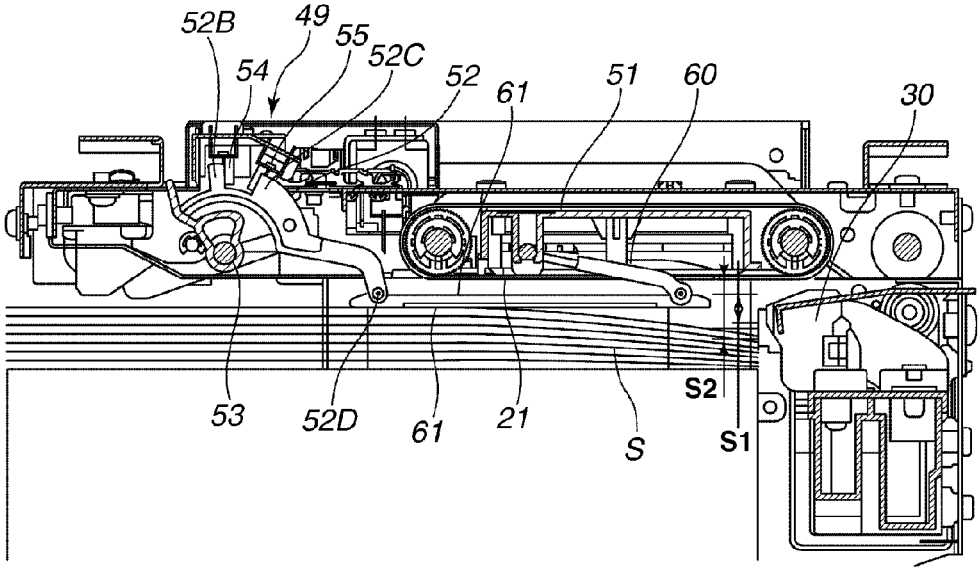

In the third exemplary embodiment of the present invention illustrated in FIG. 10, the sensor lever 52 and the detection unit 65 are replaceably attached so that the length of at least one of the sensor lever 52 and the detection unit 65 based on the detection unit 65 according to the second exemplary embodiment can be changed. Specifically, a sensor lever 520A and a sensor lever 520B which have different lengths are selectively used for the sensor lever, and a base member 65AA and a base member 65AB which have different lengths are selectively used for the detection unit 65 base member.

This configuration allows the height of the joint 52D to be changed. For example, when feeding a sheet that has a large downward curl, the distance in the height direction between the leading edge 66A of the protruding member 66 and the joint 52D can be increased by replacing the sensor lever 52 with a shorter sensor lever to increase the height of the position of the joint 52D. Consequently, by causing the sheet to contact the leading edge 66A of the protruding member 66, the leading edge of the topmost sheet Sa can be moved to a position where it can be appropriately suctioned by the suction conveyance belt 21 even for sheets having a large downward curl.

The third exemplary embodiment also enjoys the same advantageous effects as the first and second exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-253960 filed Nov. 21, 2011, which is hereby incorporated by reference herein in its entirety.

What is claimed is:

1. A sheet feeding device configured to feed sheets, the sheet feeding device comprising:

an elevating tray configured to be movable up and down and to support sheets;

an air blowing unit configured to blow air onto sheets supported on the elevating tray to float the sheets;

a suction and conveyance mechanism configured to suction and convey a topmost sheet of the sheets floated by air blown by the air blowing unit; and a sheet surface detection mechanism configured to detect an upper surface of the topmost sheet of the sheets supported on the elevating tray, wherein the sheet surface detection mechanism includes a sensor unit arranged on a upstream side of the suction and conveyance mechanism in a sheet conveyance direction, a sensor lever configured to turn the sensor unit ON/OFF, and a detection unit having one end connected to the sensor lever and another end that extends toward a downstream side in the sheet conveyance direction, and wherein the detection unit includes, on a downstream side in the sheet conveyance direction, a protruding member that protrudes in a downward direction and that is capable of contacting the topmost sheet supported on the elevating tray.

2. The sheet feeding device according to claim 1, further comprising:

a connecting member having one end rotatably connected to an edge portion on a downstream side of the detection unit and another end rotatably connected to the suction and conveyance mechanism, wherein the sensor lever, the detection unit, and the connecting member constitute a link mechanism.

3. The sheet feeding device according to claim 1, wherein the protruding member is fixed to an edge portion on a downstream side of the detection unit.

4. The sheet feeding device according to claim 1, wherein the protruding member extends further downward than a joint with the detection unit.

5. An image forming apparatus comprising:

the sheet feeding device according to claim 1; and an image forming unit configured to form an image on a sheet.

6. A sheet feeding device configured to feed sheets, the sheet feeding device comprising:

an elevating tray configured to be movable up and down and to support sheets;

an air blowing unit configured to blow air onto sheets supported on the elevating tray to float the sheets;

a suction and conveyance mechanism configured to suction and convey a topmost sheet of the sheets floated by air blown by the air blowing unit; and a sheet surface detection mechanism configured to detect an upper surface of the topmost sheet of the sheets supported on the elevating tray, wherein the sheet surface detection mechanism includes a sensor unit arranged on a upstream side of the suction and conveyance mechanism in a sheet conveyance direction, a sensor lever configured to turn the sensor unit ON/OFF, a detection unit having one end connected to the sensor lever by a joint and another end that extends toward a downstream side in the sheet conveyance direction, and a connecting member having one end connected to the suction and conveyance mechanism and another end connected to the detection unit by a joint, wherein the sensor lever, the detection unit, and the connecting member constitute a link mechanism, and wherein the detection unit includes, on a downstream edge portion in the sheet conveyance direction, a protruding member that is positioned lower than the respective joints.

7. The sheet feeding device according to claim 6, wherein the protruding member is fixed to an edge portion on a downstream side of the detection unit.

8. The sheet feeding device according to claim 6, wherein the protruding member extends further downward than a joint with the detection unit.

9. An image forming apparatus comprising:

the sheet feeding device according to claim 6; and an image forming unit configured to form an image on a sheet.

* * * * *